US005098636A

United States Patent [19]

Balk

[11] Patent Number: 5,098,636

[45] Date of Patent: Mar. 24, 1992

[54] METHOD OF PRODUCING PLASTIC FIBERS OR FILAMENTS, PREFERABLY IN CONJUNCTION WITH THE FORMATION OF NONWOVEN FABRIC

[75] Inventor: Hermann Balk, Troisdorf, Fed. Rep. of Germany

[73] Assignee: Reifenhauser GmbH & Co. Maschinenfabrik, Troisdorf, Fed. Rep. of Germany

[21] Appl. No.: 570,281

[22] Filed: Aug. 17, 1990

[30] Foreign Application Priority Data

Aug. 18, 1989 [DE] Fed. Rep. of Germany ..... 3927254

[51] Int. Cl.[5] ..... D01D 5/088

[52] U.S. Cl. ..... 264/555; 264/556; 264/174; 425/72.2

[58] Field of Search ..... 264/555, 556, 210.8, 264/174; 425/72.2

[56] References Cited

U.S. PATENT DOCUMENTS

| | | | |
|---|---|---|---|
| 3,806,289 | 4/1974 | Schwarz | 425/72.2 |
| 3,981,650 | 9/1976 | Page | 425/72.2 |
| 4,235,574 | 11/1980 | Phillips | 425/72.2 |
| 4,521,364 | 6/1985 | Norota et al. | 425/72.2 |
| 4,568,506 | 2/1986 | Kiriyama et al. | 425/72.2 |
| 4,812,112 | 3/1989 | Balk | 264/211.14 |
| 4,820,142 | 4/1989 | Balk | 264/211.14 |
| 4,820,459 | 4/1989 | Reifenhäuser | 264/210.8 |
| 4,838,774 | 6/1989 | Balk | 264/176.1 |
| 4,858,139 | 8/1989 | Wirtz | 264/40.7 |
| 4,880,370 | 11/1989 | Krumm | 425/462 |
| 4,911,868 | 3/1990 | Reifenhäuser et al. | 264/40.5 |
| 5,017,112 | 5/1991 | Mende et al. | 425/72.2 |

*Primary Examiner*—Jill L. Heitbrink
*Attorney, Agent, or Firm*—Herbert Dubno

[57] ABSTRACT

In place of discrete orifice spinnerets, a nozzle unit for thermoplastified thermoplastic material in the production of nonwoven fabric has a wide-slit nozzle at least one lip of which is formed with sawtooth serrations so that a film emerges from the nozzle and is broken up by an air stream into continuous filaments or short fibers for the production of the nonwoven fabric by the normal spun-bond drawing process or by the melt-blown process.

6 Claims, 4 Drawing Sheets

METHOD OF PRODUCING PLASTIC FIBERS OR FILAMENTS, PREFERABLY IN CONJUNCTION WITH THE FORMATION OF NONWOVEN FABRIC

FIELD OF THE INVENTION

My present invention relates to a process for producing plastic filaments and/or plastic fibers in conjunction with the production therefrom of nonwoven fabric, especially so-called spun-bond nonwoven fabric. The invention also relates to an apparatus for carrying out this method.

BACKGROUND OF THE INVENTION

Spun-bond nonwoven fabric is a fabric generally produced from filaments or fibers of plastic material, e.g. polypropylene, formed by spinnerets by a filament-drawing process or by a melt-blown process whereby the strands of the thermoplastic emerging from the spinneret are broken into fibers, disposed upon a foraminous surface against which the fibers or filaments may be drawn by suction, or otherwise transformed into a fleece of nonwoven filaments or fibers which can be bonded together.

In general, these techniques require that the thermoplastifier synthetic resin or plastic material, i.e. the thermoplastic material which is subjected to shear and like action in an extruder and liquefied under heat and pressure is fed to a distributor which, in turn, distributes the molten thermoplastic material to a spinning beam or unit from which strands of the thermoplastic material can emerge and can be contacted with an air stream.

Depending upon the nature of such contact and the type of air stream used, the processes can produce discrete filaments from individual spinnerets which are substantially endless, can pass through a drawing nozzle and can be deposited in random loops upon the foraminous collecting surface, e.g. perforated belt or the like. This process is generally referred to as a spun-bond process.

It is known to break the strand of thermoplastic material emerging from each spinneret into discrete fibers which can be similarly or differently collected in a nonwoven fleece utilizing the so-called melt-blown process.

In, for example, German patent DE-OS 25 32 900 and the publication entitled "Melt-blown Information Reifenhauser", of 18 May 1989 and disseminated by the assignee of this application, a process is described whereby the individual spinnerets of the spinning unit are fine bores with a diameter generally less than 1 mm, for example, a diameter of 0.5 mm, and a spacing in rows and columns of about 1 mm. The fabrication of such spinning units is a highly expensive matter and this type of spinning unit has a limited throughput. The individual plastic fibers or filaments have a relatively smooth surface whether the process involves filament production or the melt-blown process for producing fibers. In both cases as well, the surfaces of the plastic fibers or filaments influence the quality of the finished spun-bond nonwoven.

OBJECTS OF THE INVENTION

It is, therefore, the principal object of the present invention to provide an improved method of producing plastic filaments or fibers whereby drawbacks of earlier spinning units for such purposes are avoided.

Another object of the invention is to provide an improved spinning unit, especially for the production of nonwovens and particularly spun-bond nonwovens which has a low fabrication cost and a high throughput.

Still another object of the invention is to provide an improved method of and apparatus for the production of nonwoven fabric which makes the system more economical and free from limitations introduced by the need heretofore to provide individual spinnerets of small diameter and in closely-spaced relationship.

It is also an object of this invention to provide a spinning unit, especially for the production of spun-bond nonwoven fabric which is of simplified construction by comparison with earlier systems and which has, for a given cost, a much greater throughput than earlier spinning units having individual spinneret orifices.

SUMMARY OF THE INVENTION

These objects and other which will become apparent hereinafter are attained, in accordance with the present invention, by feeding the thermoplastified synthetic resin or plastic material through at least one wide-slit spinning nozzle defined by a pair of lips extending the length of the nozzle and in contact with the thermoplastic material, one of which is formed with a sawtooth profile.

According to the invention, the film of the thermoplastic material, having a sawtooth cross section as it emerges from this nozzle, is subjected to an air stream which breaks up the film, according to the profiling imparted thereto by the sawtooth lip, and the nature of the contact of the air stream with the film, into individual continuous filaments or into discrete relatively short fibers which can be collected to form the nonwoven fabric in the manner described.

Preferably both of these lips are provided with a sawtooth profile and the profiling is such that the film is formed with a longitudinal weakened zone or tear lines along which the air stream subdivides the film into individual strands which, depending upon the nature of the air stream, can be further torn into discrete fibers or can remain as continuous films.

The invention is based upon my surprising discovery that it is no longer necessary to operate with a spinning beam having discrete spinnerets in the form of individual circular orifices of small diameter and which have heretofore provided singular or individual thermoplastic filaments, but rather that individual continuous filaments or fibers can be produced from a thin film of the thermoplastic material emerging from a wide slit nozzle if the film is profiled by a sawtooth configuration of a lip edge or both lip edges of the nozzle in contact with the thermoplastic as it emerges from the lips.

As noted, the thin film can be broken into discrete continuous films or threads or, when the system is operated in accordance with melt-blown techniques, can be transformed into relatively short fibers.

The air stream or air stream which can be used will be described in greater detail below. It will be self-understood, of course, that the temperature-dependent rheology of the plastic film and the thickness of the plastic film must be so selected that the breakup of the film by the air stream is permitted.

In general, the wide-slit spinning nozzle of the invention can have a gap width between the lips which ranges from 0.05 to 1.0 mm, but preferably is 0.1 to 0.4 mm. The sawtooth profile is selected to maintain the gap width within these ranges.

Various sawtooth configurations can, of course, be used. Sawtooth profiles, for example, preferably have sharp vertices and roots but also can have a sinusoidal pattern or can be arrayed along the sinusoidally-shaped loop. The amplitude and wavelength can be varied to achieve a variety of effects with respect to the shape of the filaments and fibers.

In the system of the invention, the surface structure or typography of the plastic fibers or filaments can be greatly influenced and it is possible, for example, to increase the surface area of the plastic fibers over those produced from discrete orifices, since the fibers and filaments are formed by a tearing action.

According to a feature of the invention, the fibers and filaments can be subjected to the usual degree of stretching to improve the fiber and filament properties, in, for example, stretching nozzles or other stretching systems common in the production of spun-bond nonwoven fabrics.

When the wide-slit spinning nozzle of the invention is utilized in a melt-blown technique, directly upon emergence from the wide-slit spinning nozzle, the profiled film can be subjected to a hot air stream which breaks the film up into plastic fibers which can then be entrained in a cooling air stream. The cooling air stream can derive from the hot air stream and can be a separate cooling air stream. The air streams can be trained upon the film-utilizing nozzles which are defined by lips which can be of sawtooth configuration like those of the wide-slit nozzle or different from the profiling of the wide-slit nozzle.

According to the particularly advantageous feature of the invention, the hot air stream is supplied to its outlets at a pressure such that the expansion of the hot air upon emergence from the wide-slit nozzle is sufficiently strong to reduce the temperature of the air to the point that it can serve as the cooling and entraining air.

It is also possible to utilize the wide-slit nozzle of the invention in a classical spun-bond system in which the film is subdivided into continuous or substantially continuous plastic films. In that case, according to the invention, the profiled film upon emergence from the wide-slit nozzle is subdivided into the individual threads, subjected to drawing in the usual manner and deposited in the spun-bond nonwoven fabric. The drawing air can be process air drawn into the drawing nozzle by suction by the foraminous belt while the air serving to break up the film into the continuous films can be directed against the film adjacent the wide slit from which the film emerges.

In both the melt blown and classical spun-bond nonwoven fabric production it is possible to employ, with the wide-slit nozzle of the invention, a multilayer film formed with chemically and/or physically different plastic material which can then be subdivided into plastic fibers and/or continuous filaments as desired.

According to another aspect of the invention, the apparatus comprises the above-described wide-slit nozzle that has at least one and preferably two sawtooth profiled lips between which the film of thermoplastic material emerges. When this nozzle is employed in a melt-blown apparatus, according to the invention, above and below the wide-slit spinning nozzle and parallel to the latter, hot air outlet nozzles also in the form of wide-slit nozzles can be provided. In the flow direction, further downstream of the hot air outlet nozzles, cooling air outlet nozzles in the form of wide-slit nozzles can be provided.

In a preferred embodiment of the invention, the wide-slit nozzles or the hot air outlet and/or supplying the cooling air can have at least one sawtooth profile nozzle lip.

It has been found to be advantageous to provide means for adjusting the slit width of the spinning nozzle and/or the wide-slit nozzles for supplying the hot air or the cooling air.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
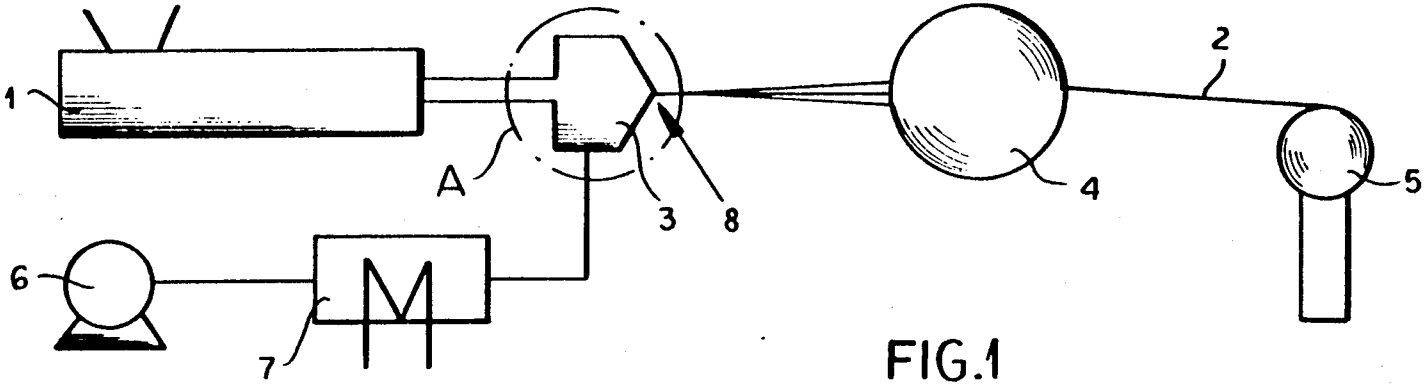
FIG. 1 is a schematic illustration of an apparatus according to the invention for producing a nonwoven by the melt-blown technique.

In FIG. 1 I have shown an extruder 1 for the thermoplastification of a thermoplastic synthetic resin, e.g. polypropylene, which is to be made into a spun-bond nonwoven as shown at 2 in this Figure.

The apparatus comprises a spinning nozzle unit 3 and a so-called collector 4 as is commonly used in melt-blown technology for collecting the fibers which are produced and forming them into a nonwoven fabric. A cooling unit 5 is provided to wind up the completed spun-bond nonwoven fabric 2 in a roll.

As is the case in melt-blown technology, the spinning nozzle unit 3 is connected to a compressor 6 which communicates with an air heater 7. In this manner, hot air can be fed to the spinning-nozzle unit 3. A further compressor, not shown, permits the introduction downstream of the spinning nozzle unit 3 at 8 of cooling air.

Figure 2:
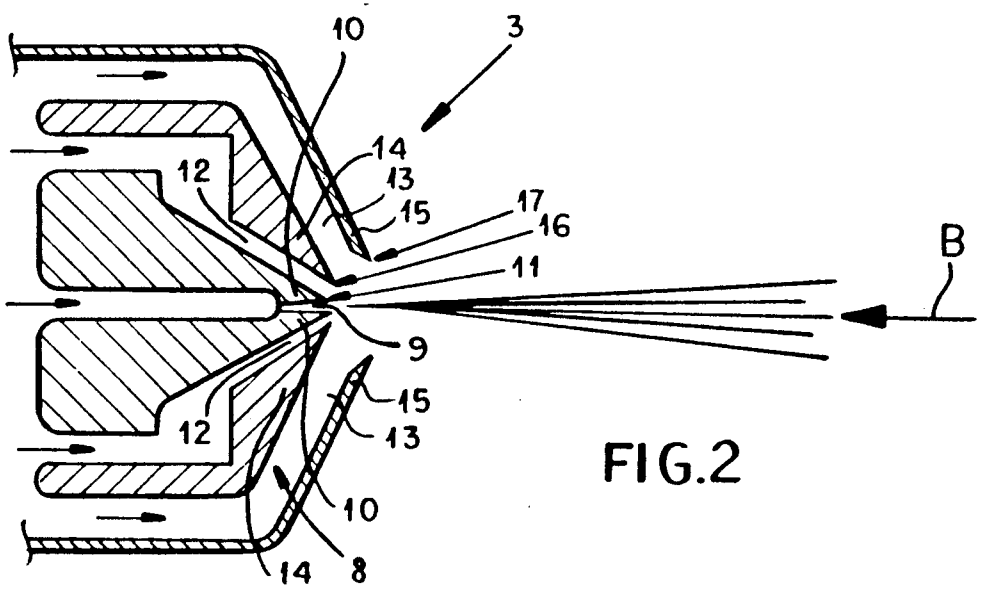
FIG. 2 is a detail view of the region A of FIG. 1 in cross section.

FIG. 2 shows the greatly enlarged scale that comprising with FIG. 1 is the construction of the spinning-nozzle unit 3. While the sawtooth or serrated lip configuration will be described in connection with this Figure, the scale of the drawing does not permit the serrations to be discernible either in this Figure or in FIG. 3. The serrated configuration of the lips is, however, clearly visible in FIG. 4.

Figure 3:
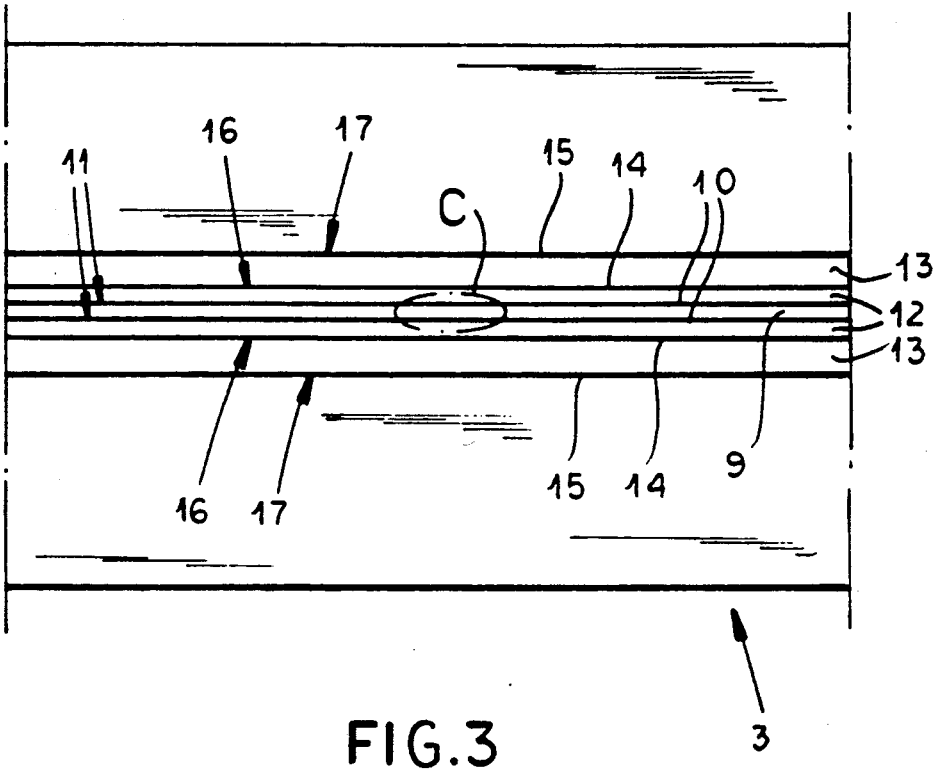
FIG. 3 is a view of the wide-slit nozzle taken in the direction of the arrow B in FIG. 2.
Figure 4:
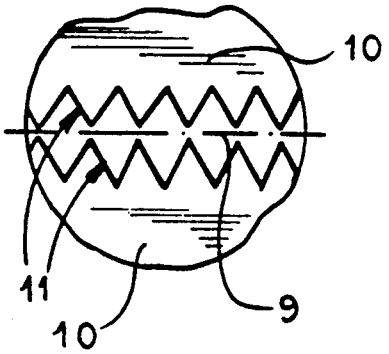
FIG. 4 is a detail view of the region C of FIG. 3.

From FIGS. 2–4 it will be apparent that the spinning-nozzle unit 3 comprises a wide-slit spinning nozzle 9 which can extend the full width of the belt, i.e. the full machine width, if desired. In the embodiment shown, the wide-slit spinning nozzle 9 is defined between two nozzle lips 10 of sawtooth serrated profile, (see FIG. 4).

Above and below the wide-slit spinning nozzle 9 and parallel thereto, are hot air outlet nozzles 12 also formed as wide-slit nozzles. The wide-slit nozzles 12 dispensing hot air are disposed to direct sheet-like jets or air against the film emerging from the orifice 9 precisely at the location at which the film emerges.

Further downstream, the cooling air outlet nozzles 13 are directed at the fibers which have been serrated from the filament and serve to entrain the fibers to the collector 4.

The lips of the wide-slit nozzles 12 delivering the hot air and of the nozzles 13 supplying the cooling air are represented at 14 and 15 and can have sawtooth profiles as well.

The slit width of the nozzle 9 and the slit widths of the nozzles 12 and 13 can be adjustable as will be described below. The forms of the sawtooth profiling or serrations 11, 16 and 17, not shown in detail, can differ from one another with respect to the depth of the saw-teeth, the spacing of the saw-teeth and the shapes of the saw-teeth.

Figure 5:
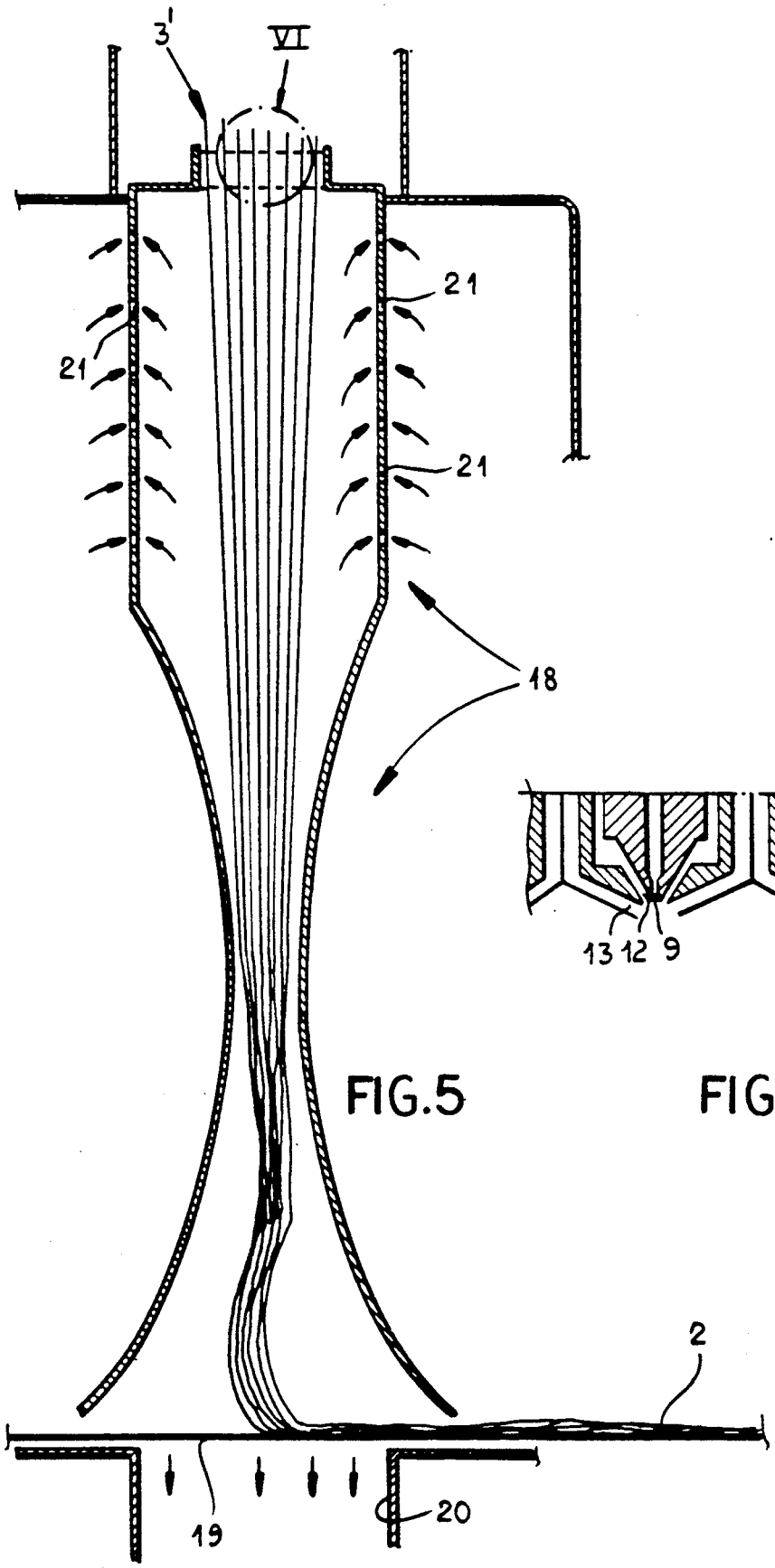
FIG. 5 is a diagrammatic section of an apparatus for the production of spun-bond nonwoven fabric utilizing the drawing of continuous filaments.
Figure 6:
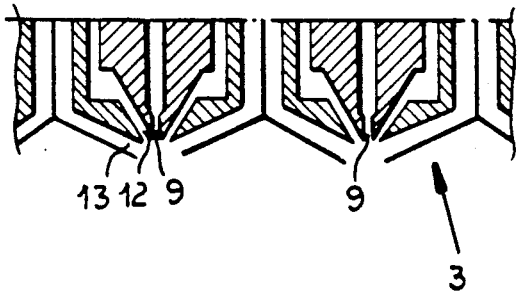
FIG. 6 is a cross sectional view of the region VI of FIG. 5.

FIGS. 5 and 6 illustrate an apparatus whereby the spun-bond nonwoven fabric 2 is formed from endless threads. In this embodiment, the spinning unit 3' can be seen to comprise a number of wide-slit spinning nozzles 9 disposed side-by-side on a spinning beam, the nozzle slits running parallel to one another and perpendicular to the plane of the paper in FIGS. 5 and 6. The nozzles 12 and 13 can supply cooling air and generally the nozzles 12 can be supplied with cooling air at a relatively low pressure so as not to excessively tear into individual films which remain more or less continuous, but not torn into fibers.

The individual filaments are then drawn in a stretching and cooling column 18 and deposited on a foraminous belt 19 which is displaced across a suction box 20. The principle of such spun-bond production is discussed in the following commonly-owned U.S. patents:

U.S. Pat. No. 4,838,774
U.S. Pat. No. 4,820,459
U.S. Pat. No. 4,812,112
U.S. Pat. No. 4,820,142

It is also possible to operate here without cooling air from the nozzle 13 and to effect the tearing of the film into individual films slowly by the air induced into the cooling and stretching shaft 18 by the suction applied from beneath the belt. To that end, the upper end of the shaft 18 can have inlets 21 for cooling and process air, for example, ambient air.

Figure 7:
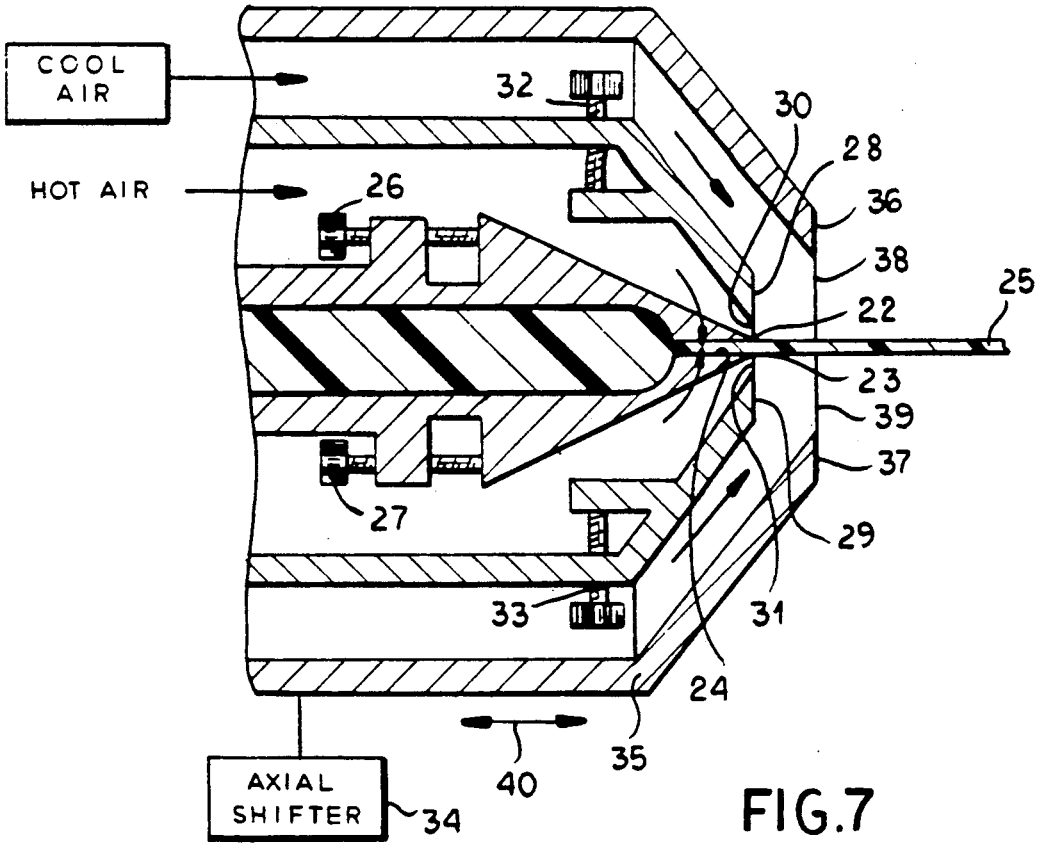
FIG. 7 is a cross sectional view through another nozzle according to the invention, especially for use in melt-blown fiber production of nonwoven fabric.

From FIG. 7 it will be apparent that the lips 22 and 23, provided with sawtooth profiles, of the nozzle 24 from which the film 25 emerges, can be moved toward and away from one another by deflecting these lips via, for example, screws 26 and 17. The screws 26 and 27 are, of course, representative of a multiplicity of such screws acting on each lip along the length of the wide-slit nozzle. Similarly, the lips 28 and 29 defining the hot air outlets 30 and 31 may be moved toward and away form one another by manipulation of screws 32 and 33, similarly arrayed along the width of the nozzle. Finally, means 34 can be provided to longitudinally shift the housing 35 formed with the lips 36 and 37 defining the cold air outlets 38 and 39 represented by the arrow 40 and thereby vary the gap through which the cooling air emerges.

Figure 8A:
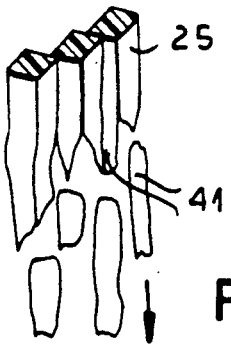
FIGS. 8A and 8B are diagrams illustrating the subdivision of the profiled film into fibers and filaments respectively.
Figure 8B:
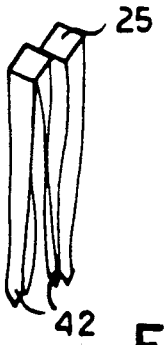

In FIG. 8, I have diagrammatically shown the film 25 as it is broken up into the individual fibers 41 by the tearing action of the hot-air jets. FIG. 8B shows that the film 25 can also be broken into continuous films 42 for use in the spun-bond process of FIG. 5.

Figure 9:
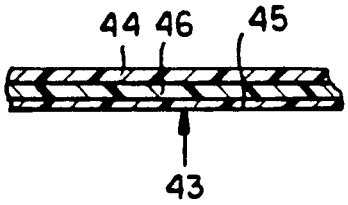
FIG. 9 is a cross sectional view of a film which can be used in accordance with the invention.

FIG. 9 illustrates in cross section and greatly enlarged in scale, a part of the film before it is broken into fibers or filaments and from which it can be seen that utilizing the broad-slit nozzle of the invention, a laminated film structure 43 can be made with outer layers 44 and 45 flanking an inner layer 46. The layers can have different chemical compositions, i.e. can be different thermoplastics, or can be composed of a thermoplastic whose layers have different physical properties. Such laminated films can be produced by a laminating nozzle of the type shown in U.S. Patents:

U.S. Pat. No. 4,880,370
U.S. Pat. No. 4,858,139
U.S. Pat. No. 4,911,868.

Figure 10:
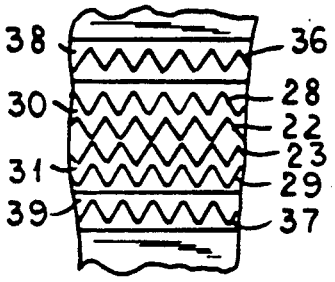
FIG. 10 is a view generally similar to FIG. 4 but showing the arrangement of FIG. 7 in accordance with this invention.

FIG. 10 shows that the lips 22 and 23 can have sawtooth profiles and that the lips 28 and 29 defining the hot air nozzles 30, 31 can have similar sawtooth profiles. The lips 36 and 37 defining the cooling air outlets 38 and 39 can have somewhat flatter serrated profiles.

I claim:

1. A method of producing plastic filaments or plastic fibers in the production of a nonwoven fabric, comprising the steps of:

(a) feeding a thermoplastified thermoplastic material through a wide-slit spinning nozzle having at least one lip in contact with the thermoplastic material formed with sawtooth serrations, thereby producing a sawtooth profile film;

(b) contacting said film with at least one air stream directed against said film immediately downstream of said spinning nozzle from a wide-slit air nozzle defined by at least one sawtooth-profile lip and extending along said spinning nozzle to subdivide said film into fibers or filaments; and (c) collecting said fibers or filaments in a nonwoven fabric.

2. The method defined in claim 1 wherein said air stream is directed at said film directly upon emergence from said wide-slit spinning nozzle as a hot air stream transforming said film into fibers by a melt-blown technique, said method further comprising the step of entraining said fibers in a cooling air stream.

3. The method defined in claim 2 wherein said air stream is supplied under such pressure that, upon emergence, it expands and cools to form said cooling air stream.

4. The method defined in claim 1 wherein said air stream breaks up said film into endless filaments, said method further comprising the step of drawing said filaments prior to collecting same in said nonwoven fabric.

5. The method defined in claim 1 wherein said film is a multilayer film formed with chemically-defined thermoplastic layers.

6. The method defined in claim 1 wherein said film is a multilayer film formed with layers having different physical properties from one another.

* * * * *